US011353811B2

(12) United States Patent
Imaeda et al.

(10) Patent No.: US 11,353,811 B2
(45) Date of Patent: Jun. 7, 2022

(54) FIXING DEVICE AND IMAGE FORMING APPARATUS

(71) Applicant: BROTHER KOGYO KABUSHIKI KAISHA, Nagoya (JP)

(72) Inventors: Hirotaka Imaeda, Nagoya (JP); Kenji Takeuchi, Nagoya (JP); Tokifumi Tanaka, Aichi (JP); Tomonori Watanabe, Aichi (JP); Tatsuo Ogasawara, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/205,747

(22) Filed: Mar. 18, 2021

(65) Prior Publication Data

US 2021/0311422 A1 Oct. 7, 2021

(30) Foreign Application Priority Data

Apr. 1, 2020 (JP) ..... JP2020-065590

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/657; G03G 15/2017; G03G 15/2028; G03G 15/2053; G03G 2215/00413; G03G 2215/2003; G03G 2215/2009
See application file for complete search history.

(56) References Cited

U.S. PATENT DOCUMENTS

2006/0210288 A1* 9/2006 Hayashi ..... G03G 15/2039 399/33
2010/0189478 A1 7/2010 Takahashi
2012/0275835 A1 11/2012 Kuroda
2014/0233991 A1* 8/2014 Moon ..... G03G 15/657 399/322
2017/0242380 A1 8/2017 Hayashi et al.
2018/0284666 A1* 10/2018 Fujii ..... G03G 15/2064

FOREIGN PATENT DOCUMENTS

JP 2010-169903 A 8/2010
JP 2012-230278 A 11/2012
JP 2015-132722 A 7/2015
JP 2016-065975 A 4/2016
JP 2017-151136 A 8/2017
JP 2017-194506 A 10/2017
JP 2018-010221 A 1/2018

* cited by examiner

*Primary Examiner* — Thomas S Giampaolo, II
(74) *Attorney, Agent, or Firm* — Merchant & Gould P.C.

(57) ABSTRACT

A fixing device includes a roller having a rotation axis, and a belt unit that conveys a sheet in combination with the roller. The belt unit includes an endless belt, a nip forming member that forms a nip in combination with the roller, and an upstream belt guide. The fixing device further includes a chute having a guide surface configured to guide the sheet toward the nip. In a section orthogonal to the rotation axis, a line segment connecting a downstream end of the guide surface and an upstream end of the nip does not intersect the upstream belt guide, and an extended line extended from the downstream end of the guide surface along the guide surface toward the roller intersects a surface of the roller at a position upstream of an upstream end of the nip.

15 Claims, 6 Drawing Sheets

FIXING DEVICE AND IMAGE FORMING APPARATUS

CROSS-REFERENCE TO RELATED APPLICATION(S)

This application claims priority from Japanese Patent Application No. 2020-065590 filed on Apr. 1, 2020, the disclosure of which is incorporated herein by reference in its entirety.

TECHNICAL FIELD

The present invention relates to a fixing device that thermally fixes a toner image on a sheet and an image forming apparatus including the fixing device.

BACKGROUND ART

A fixing device provided with an upstream guide that guides a sheet to an endless belt to thermally fix a toner image on the sheet conveyed on the endless belt is known in the art. In this fixing device, the upstream guide extends toward the endless belt, and the sheet guided by the upstream guide enters a nip after contacting the endless belt.

SUMMARY

In comparison with an alternative configuration in which the nip is formed between two rollers, the endless belt of which a trajectory of rotation tends to become unstable would be problematic. In particular, when a guide is positioned such that the sheet entering a nip formed between the endless belt and a roller first contacts the belt, the path of the sheet guided to the nip would possibly become unstable which would result in wrinkles formed on the sheet.

It would be desirable to guide a sheet stably to a nip of the fixing device and restrain the sheet from being wrinkled.

In one aspect, a fixing device disclosed herein comprises a roller having a rotation axis, and a belt unit that conveys a sheet in a conveyance direction in combination with the roller. The belt unit comprises an endless belt, a nip forming member that forms a nip in combination with the roller between the roller and the endless belt, and an upstream belt guide that guides an inner surface of the endless belt at a position upstream of the nip in the conveyance direction. The endless belt is sandwiched between the nip forming member and the roller. The nip has an upstream end in the conveyance direction. The fixing device further comprises a chute having a guide surface configured to guide the sheet toward the nip. The guide surface has an upstream end and a downstream end in the conveyance direction.

In a section orthogonal to the rotation axis, a line segment connecting the downstream end of the guide surface and the upstream end of the nip does not intersect the upstream belt guide, and an extended line extended from the downstream end of the guide surface along the guide surface toward the roller intersects a surface of the roller at a position upstream of the upstream end of the nip.

In another aspect, an image forming apparatus disclosed herein comprises a fixing device as described above, a conveyor belt configured to convey a sheet with a toner image formed thereon to the guide surface of the chute, a belt roller around which the conveyor belt is looped, and a belt frame configured to support the belt roller. The upstream end of the guide surface is located at a position lower than a position of a sheet conveyance surface of the conveyor belt and at a position upstream of a position of a downstream end of the belt frame in the conveyance direction.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

A detailed description will be given of a non-limiting embodiment with reference made to the drawings where appropriate.

Figure 1:
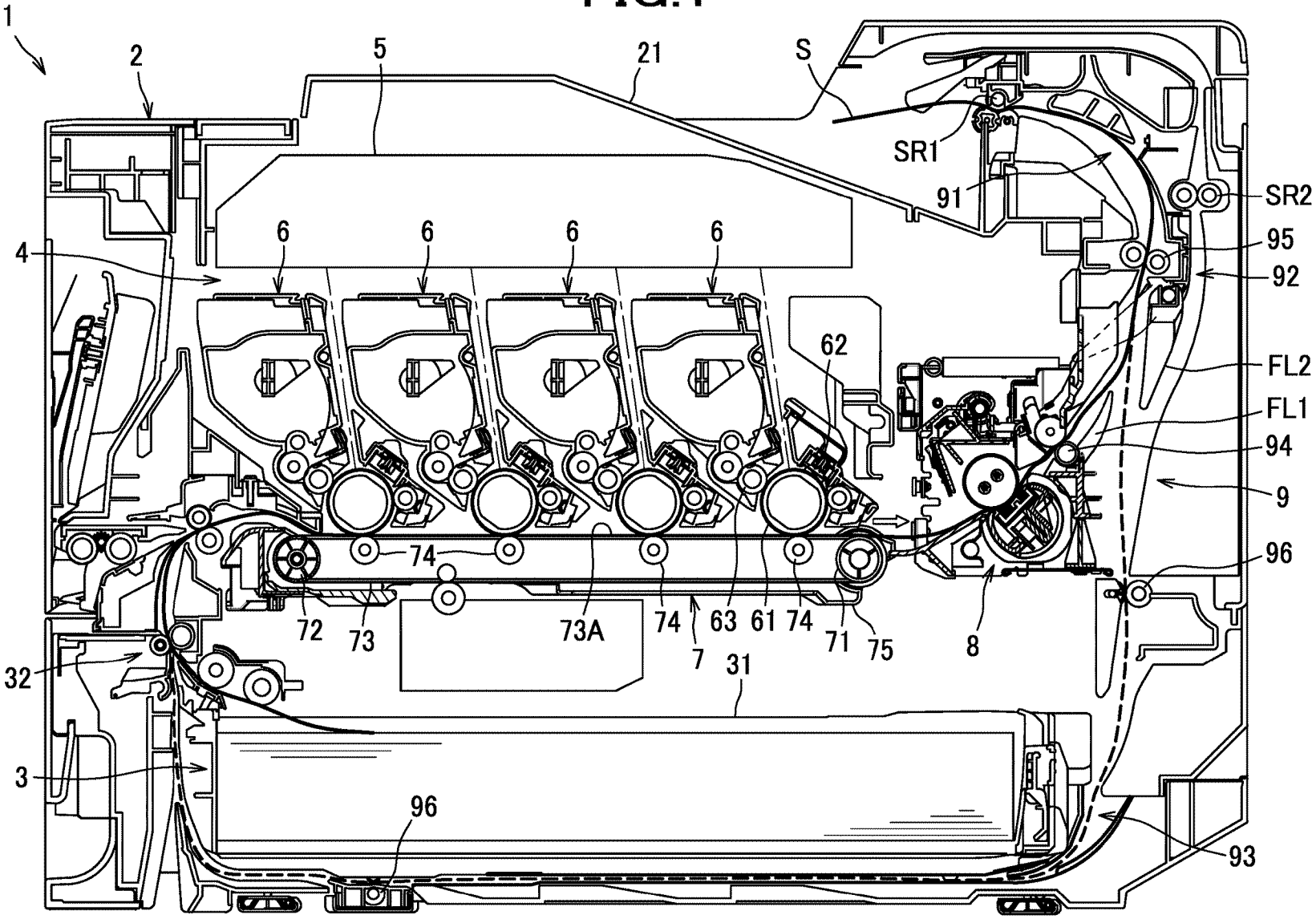
FIG. 1 is a sectional view of an image forming apparatus including a fixing device.

As shown in FIG. 1, an image forming apparatus 1 is configured to form an image on both sides of a sheet S (e.g., of paper). The image forming apparatus 1 comprises a housing 2, and several units arranged inside the housing 2, which include a feeder unit 3, an image forming unit 4, a fixing device 8, and a conveying unit 9. In the illustrated example, the image forming apparatus 1 is a color printer.

The housing 2 comprises an output tray 21. The output tray 21 is formed on a top surface of the housing 2.

The feeder unit 3 is arranged in a lower part of the housing 2. The feeder unit 3 comprises a sheet tray 31 that holds sheets S, and a feeding mechanism 32 for feeding the sheets S in the sheet tray 31 to the image forming unit 4.

The image forming unit 4 has a function of transferring toner images to a sheet S to form an image on the sheet S and comprises an exposure device 5, four process cartridges 6, and a transferring unit 7.

The exposure device 5 is provided in an upper part of the housing 2, and comprises a light source, a polygon mirror, etc. (not shown). The exposure device 5 is configured to rapidly scan a surface of a photoconductor drum 61 with a light beam (shown by alternate long and short dashed lines) in accordance with image data, to thereby expose the surface of the photoconductor drum 61 to light.

Each process cartridge 6 comprises the photoconductor drum 61, a charger 62, and a development roller 63. The four process cartridges 6 respectively contain toners of yellow, magenta, cyan, and black.

The transferring unit 7 comprises a drive roller 71 as an example of a belt roller, a follower roller 72, a conveyor belt 73, four transfer rollers 74, and a belt frame 75. The conveyor belt 73 is an endless belt. The conveyor belt 73 conveys a sheet S with a toner image formed thereon to a guide surface 151 of a chute 150 of the fixing device 8 (see FIG. 2).

The belt frame 75 supports the drive roller 71 and the follower roller 72 in such a manner that the drive roller 71 and the follower roller 72 are rotatable. The belt frame 75 has an end 75E downstream in a direction of conveyance of the sheet S, which will herein be referred to as downstream end 75E. The conveyor belt 73 is looped around the drive roller 71 and the follower roller 72. The upper surface of the conveyor belt 73 is a sheet conveying surface 73A for conveying the sheet S. The transfer rollers 74 are positioned on the inner side of the conveyor belt 73. The conveyor belt 73 is held between the transfer rollers 74 and corresponding photoconductor drums 61.

Hereafter, the direction of conveyance of the sheet S is simply referred to as "conveyance direction". The conveyance direction is the direction in which the sheet S proceeds along a conveyance path of the sheet S shown in FIG. 1.

The charger 62 charges the surface of the photoconductor drum 61. The exposure device 5 exposes the charged surface of the photoconductor drum 61 to light to form an electrostatic latent image on the surface of the photoconductor drum 61 in accordance with the image data.

The development roller 63 supplies toner to the electrostatic latent image formed on the surface of the photoconductor drum 61. Accordingly, a toner image is formed on the photoconductor drum 61. When a sheet S is conveyed by the conveyor belt 73 through between the photoconductor drum 61 and the transfer roller 74, the toner image on the surface of the photoconductor drum 61 is transferred onto the sheet S.

The fixing device 8 is a device that thermally fixes a toner image on a sheet S. The details of the fixing device 8 will be described later.

The conveying unit 9 is configured to convey a sheet S ejected from the fixing device 8 to the outside of the housing 2 or toward the image forming unit 4 again. The conveying unit 9 comprises a first conveyance path 91, a second conveyance path 92, a reconveyance path 93, a first conveyance roller 94, a second conveyance roller 95, a first switchback roller SR1, a second switchback roller SR2, a plurality of reconveyance rollers 96, a swingable first flapper FL1, and a swingable second flapper FL2.

The first conveyance path 91 guides a sheet S ejected from the fixing device 8 toward the output tray 21. The second conveyance path 92 guides a sheet S ejected from the fixing device 8 toward the output tray 21 along a route different from the first conveyance path 91. The reconveyance path 93 guides a sheet S drawn back into the housing 2 to the feeding mechanism 32 upstream of the image forming unit 4. The sheet S is drawn into the housing 2 by the first switchback roller SR1 and other parts which will be described later. The reconveyance rollers 96 are provided in the reconveyance path 93 and convey a sheet S in the reconveyance path 93 toward the feeding mechanism 32.

The first conveyance roller 94 is provided in the fixing device 8. The first conveyance roller 94 conveys a sheet S with a toner image thermally fixed thereon toward the second flapper FL2.

The second conveyance roller 95, the first switchback roller SR1, and the second switchback roller SR2 are rotatable in forward and reverse directions. The second conveyance roller 95, the first switchback roller SR1, and the second switchback roller SR2 convey a sheet S toward the outside of the housing 2, specifically toward the output tray 21 when rotated in the forward direction, and draw a sheet S back into the housing 2 when rotated in the reverse direction.

The second conveyance roller 95 and the first switchback roller SR1 are provided in the first conveyance path 91. The first switchback roller SR1 is located closer, than the second conveyance roller 95, to the output tray 21. The second switchback roller SR2 is provided in the second conveyance path 92.

In the conveying unit 9, the appropriate switching of the first flapper FL1 and the second flapper FL2 allows a sheet S to be conveyed from the fixing device 8 toward the first conveyance path 91 or the second conveyance path 92, or a sheet S to be conveyed from the first conveyance path 91 or the second conveyance path 92 to the reconveyance path 93.

Figure 2:
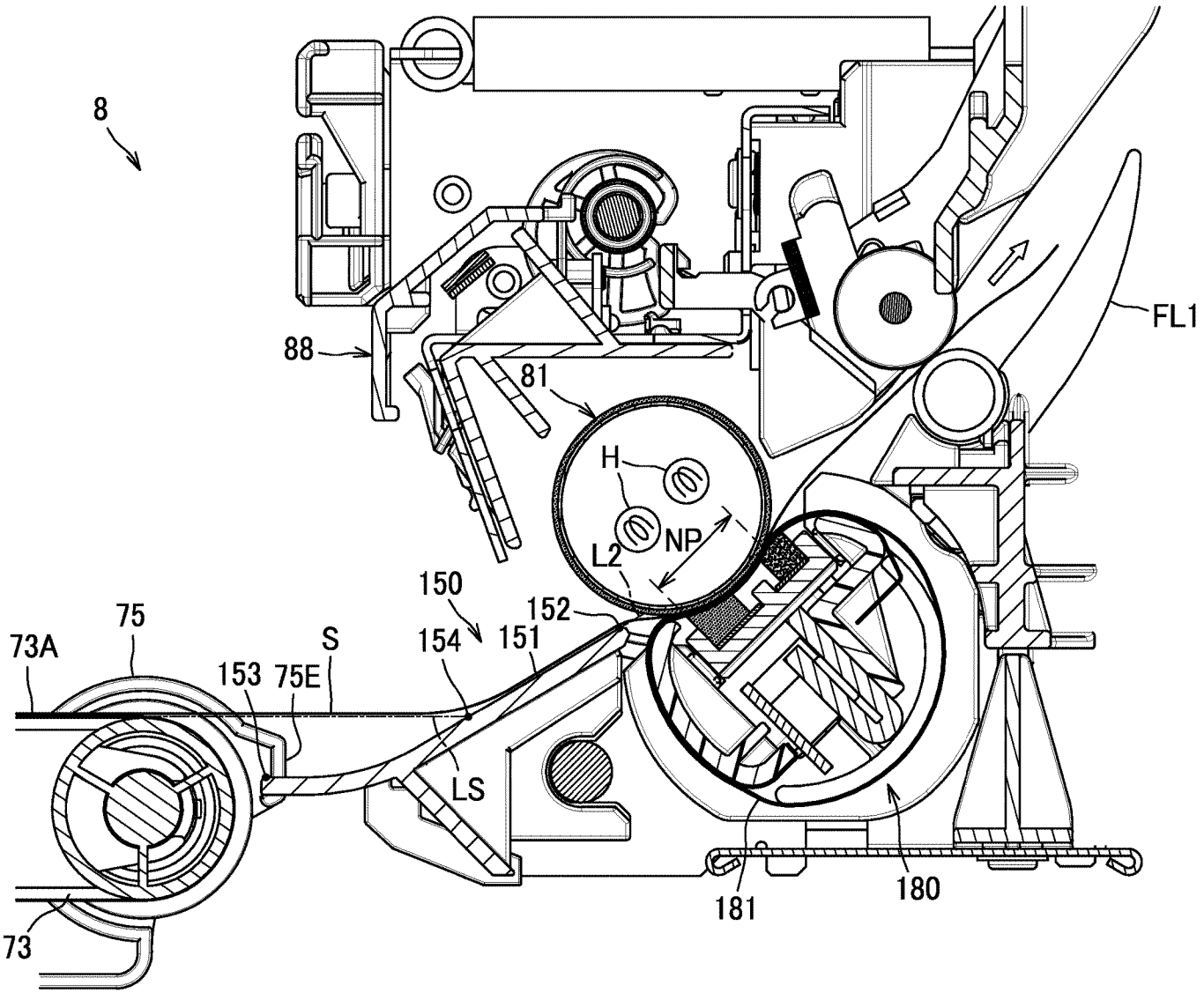
FIG. 2 is a sectional view of the fixing device and its vicinity.

As shown in FIG. 2, the fixing device 8 comprises two heaters H, a roller 81, a belt unit 180, a chute 150, a fixing frame 88, a nip pressure adjustment mechanism 200 (see FIG. 4), and the first flapper FL1 described above.

Figure 3:
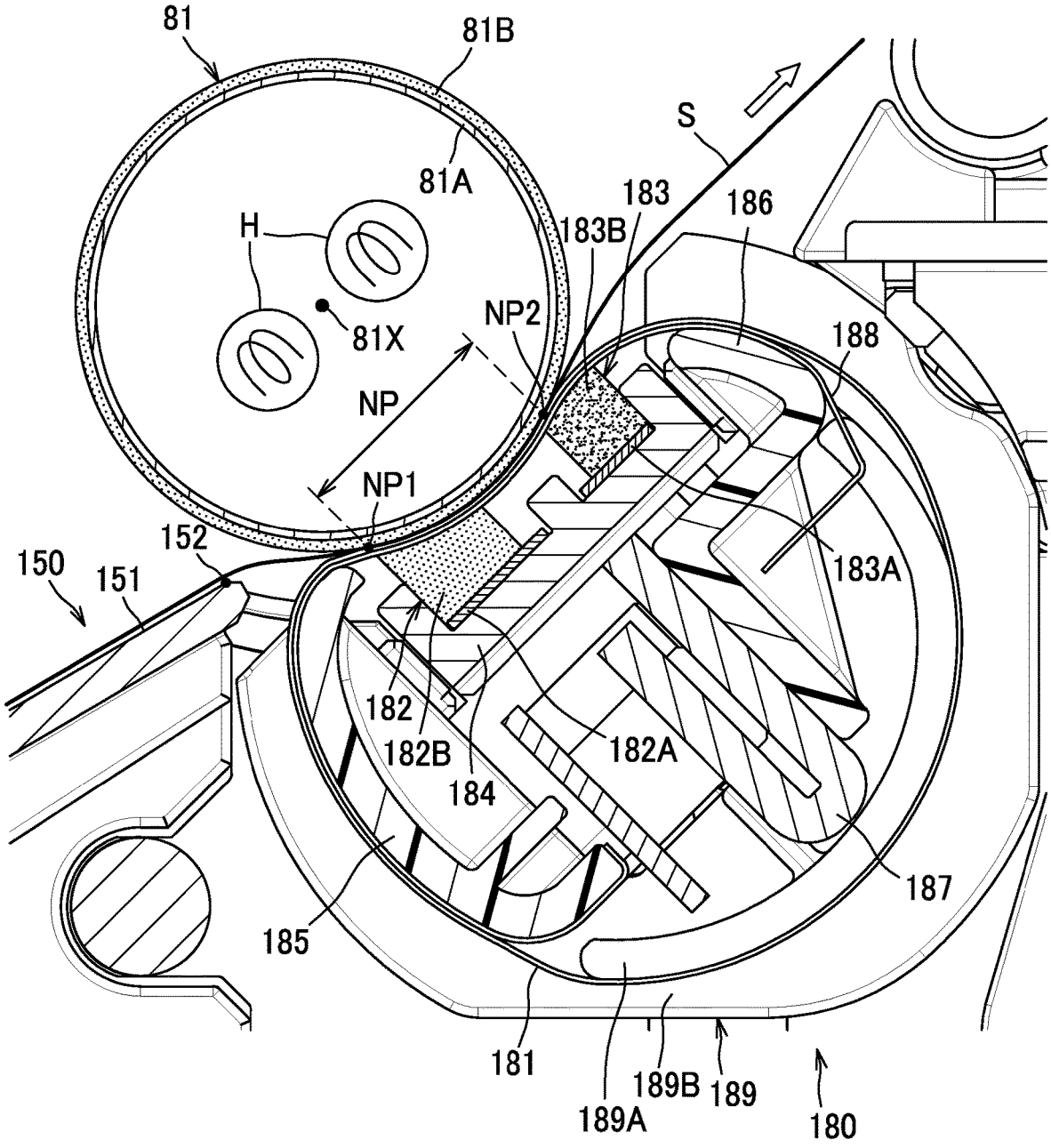
FIG. 3 is an enlarged sectional view of the heating roller and the belt unit and their vicinities.

As shown in FIG. 3, the roller 81 comprises a base pipe 81A and an elastic layer 81B.

The base pipe 81A is made of metal. The roller 81 is rotatably supported on the fixing frame 88 via a bearing (not shown) about a rotation axis 81X. The roller 81 is driven to rotate by a motor (not shown) provided in the image forming apparatus 1.

The elastic layer 81 is provided on the outer periphery of the base pipe 81A. In other words, the roller 81 comprises an elastic layer 81B forming a surface thereof. The elastic layer 81B has elasticity.

The two heaters H are arranged inside the base pipe 81A of the roller 81 and heat the roller 81.

The belt unit 180 forms a nip NP in combination with the roller 81. The nip NP is formed between the belt unit 180 and the roller 81. A sheet S is sandwiched between the belt unit 180 and the roller 81 and conveyed thereby. The nip NP has an end NP1 upstream in the conveyance direction (which will herein be referred to as upstream end NP1) and an end NP2 downstream in the conveyance direction (which will herein be referred to as downstream end NP2). The belt unit 180 comprises an endless belt 181, two nip forming members 182, 183, a supporting member 184, an upstream belt guide 185, a downstream belt guide 186, a stay 187, a sliding sheet 188, and side guides 189.

The belt 181 is an endless belt made of metal or the like. The belt 181 has a width wider than that of a largest sheet S that may be transferred in the image forming apparatus 1. The belt 181 has sides facing outward in an axial direction that is a direction parallel to the axis 81X of rotation of the roller 81. The direction parallel to the axis 81X of rotation of the roller 81 is hereafter referred to simply as "axial direction" and the terms "axial side" or "axial end" refer to the side or end facing outward in a direction parallel to the direction of the axis 81X of rotation of the roller 81. A sheet S is sandwiched between the belt 181 and the roller 81 and conveyed thereby.

The nip forming members 182, 183 form the nip NP in combination with the roller 81. The belt 181, the sliding sheet 188, and the sheet S are sandwiched between the nip forming member 182 and the roller 81, and between the nip forming member 183 and the roller 81.

The nip forming member 182 comprises a supporting plate 182A, and an upstream elastic pad 182B. The upstream elastic pad 182B is fixed on the supporting plate 182A. The upstream elastic pad 182B has elasticity and is elastically deformable. In the illustrated example, the upstream elastic pad 182B is made of the same material as that of the elastic layer 81B. The upstream elastic pad 182B is thicker than the elastic layer 81B so that when the roller 81 and the nip forming member 182 are pressed against each other, deformation of the elastic layer 81B is smaller than that of the upstream elastic pad 182B.

The nip forming member 183 comprises a supporting plate 183A, and a downstream elastic pad 183B. The downstream elastic pad 183B is fixed on the supporting plate 183A. The downstream elastic pad 183B has elasticity and is elastically deformable. In the illustrated example, the downstream elastic pad 183B is made of a material with a higher elastic modulus than that of the elastic layer 81B. However, since the downstream elastic pad 183B is thicker than the elastic layer 81B, when the roller 81 and the nip forming member 183 are pressed against each other, deformation of the elastic layer 81B is smaller than that of the downstream elastic pad 183B.

The supporting member 184 supports the nip forming members 182, 183.

The upstream belt guide 185 guides an inner surface of the belt 181 at a position upstream of the nip NP in the conveyance direction. The inner surface of the belt 181 is guided along a curved surface of the upstream belt guide 185. The curved surface of the upstream belt guide 185 allows the endless belt 181 to rotate smoothly.

The downstream belt guide 186 guides movement of the belt 181 at a position downstream of the nip NP in the conveyance direction. The downstream belt guide 186 has a curved surface which allows the endless belt 181 to rotate smoothly.

The stay 187 supports the supporting member 184, the upstream belt guide 185, the downstream belt guide 186, and the side guides 189. The stay 187 is made by press forming sheet metal.

The sliding sheet 188 is a sheet-like member placed between the belt 181 and each of the upstream belt guide 185, the nip forming members 182, 183, and the downstream belt guide 186. The sliding sheet 188 is formed of a material having superior sliding properties and has projections and depressions for holding grease on a surface facing the belt 181. The sliding sheet 188 has a coefficient of friction lower than that of the upstream belt guide 185.

The side guides 189 are arranged on both sides of the belt 181. The side guides 189 each comprise an inner periphery guide 189A and a flange 189B. The inner periphery guide 189A is disposed in the inside of the belt 181 and has an arc shape as viewed from a direction parallel to the axis 81X. The flange 189B extends from the inner periphery guide 189B in a direction orthogonal to the rotation axis 81X. The flange 189B prevents the belt 181 from moving in the axial direction.

Figure 4:
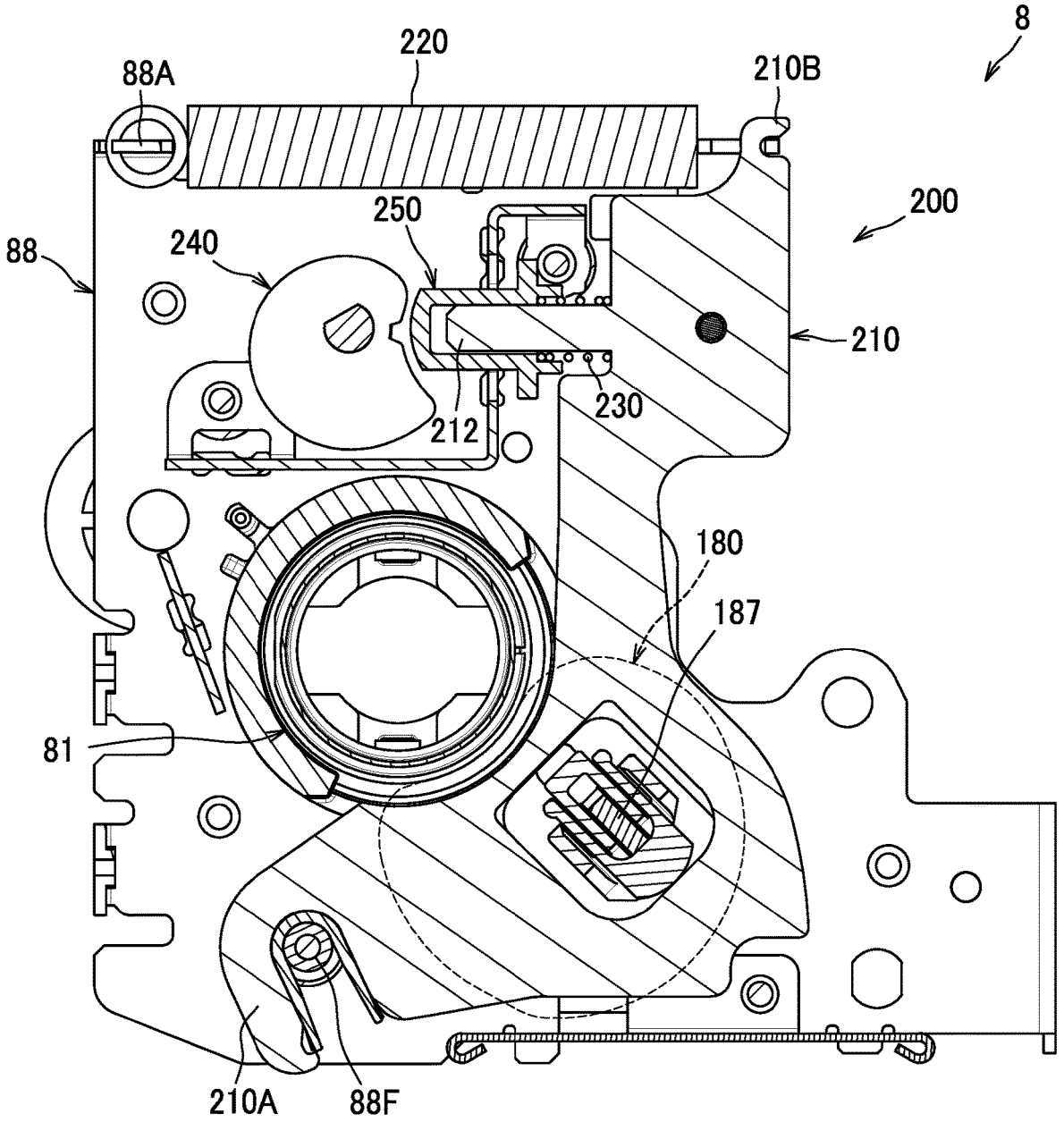
FIG. 4 is an illustration showing a nip pressure adjustment mechanism.

As shown in FIG. 4, the nip pressure adjustment mechanism 200 comprises swing arms 210, a first spring 220, a second spring 230, a cam 240, and a cam follower 250. Although FIG. 4 shows the nip pressure adjustment mechanism 200 positioned on one axial side of the fixing frame 88, a nip pressure adjustment mechanism with a similar structure is also positioned on the other axial side of the fixing frame 88.

One swing arm 210 is arranged on each axial end of the fixing frame 88. One end 210A of each swing arm 210 is swingably supported on a shaft 88F provided on the fixing frame 88. One end of the first spring 220 is hooked onto the other end 210B of each swing arm 210. The first spring 220 is a tension spring. The other end of the first spring 220 is hooked onto a spring hook portion 88A provided on the fixing frame 88. The first spring 220 continuously biases the swing arm 210 in the counterclockwise direction of FIG. 5. The swing arm 210 supports the stay 187 of the belt unit 180 via a number of members so that the belt unit 180 is supported swingably with respect to the fixing frame 88.

The swing arm 210 comprises a guide protrusion 212 protruding toward the cam 240. The cam follower 250 is slidably engaged with the guide protrusion 212. The second spring 230, which is a compression spring, is placed between the can follower 250 and a base portion of the swing arm 210 from which the guide protrusion 212 protrudes.

The cam 240 is positioned to face the cam follower 250 and is rotated by a motor (not shown). When the cam 240 rotates, it pushes the cam follower 250 causing the swing arm 210 to swing. This causes the belt unit 180 to move relative to the roller 81, and the nip pressure between the roller 81 and the belt unit 180 is thereby adjusted. Specifically, by the rotation of the cam 240 the nip pressure can be adjusted to a suitable pressure predetermined among a strong nip state, a weak nip state, and a nip-release state. The strong nip state requires the strongest nip pressure suitable, for example, for fixing of ordinary paper. The weak nip state is suitable for fixing of paper thicker than that of the strong nip state. The nip-release state requires the smallest nip pressure suitable for removing a sheet S jammed in the fixing device 8.

As shown in FIG. 2, the chute 150 has the guide surface 151 for guiding a sheet S conveyed from the conveyor belt 73, toward the nip NP between the roller 81 and the belt 181. The guide surface has an end 153 upstream in the conveyance direction and an end 152 downstream in the conveyance direction. Hereafter, the end 153 will be referred to as upstream end 153 and the end 152 will be referred to as downstream end 152. The chute 150 further has a planar chamfer 155 on its end near the roller 81 (see FIG. 5).

The upstream end 153 of the guide surface 151 is positioned lower than the sheet conveying surface 73A of the conveyor belt 73. In other words, a straight line LS extending the sheet conveying surface 73A toward the chute 150 intersects the guide surface 151. Further, the upstream end 153 of the guide surface 151 is positioned upstream in the conveyance direction relative to the downstream end 75E of the belt frame 75. Downstream ends 75E of the belt frame 75 are located on both sides of the belt 73 and are located on both sides of a sheet S conveyed to the conveyor belt 73.

Figure 5:
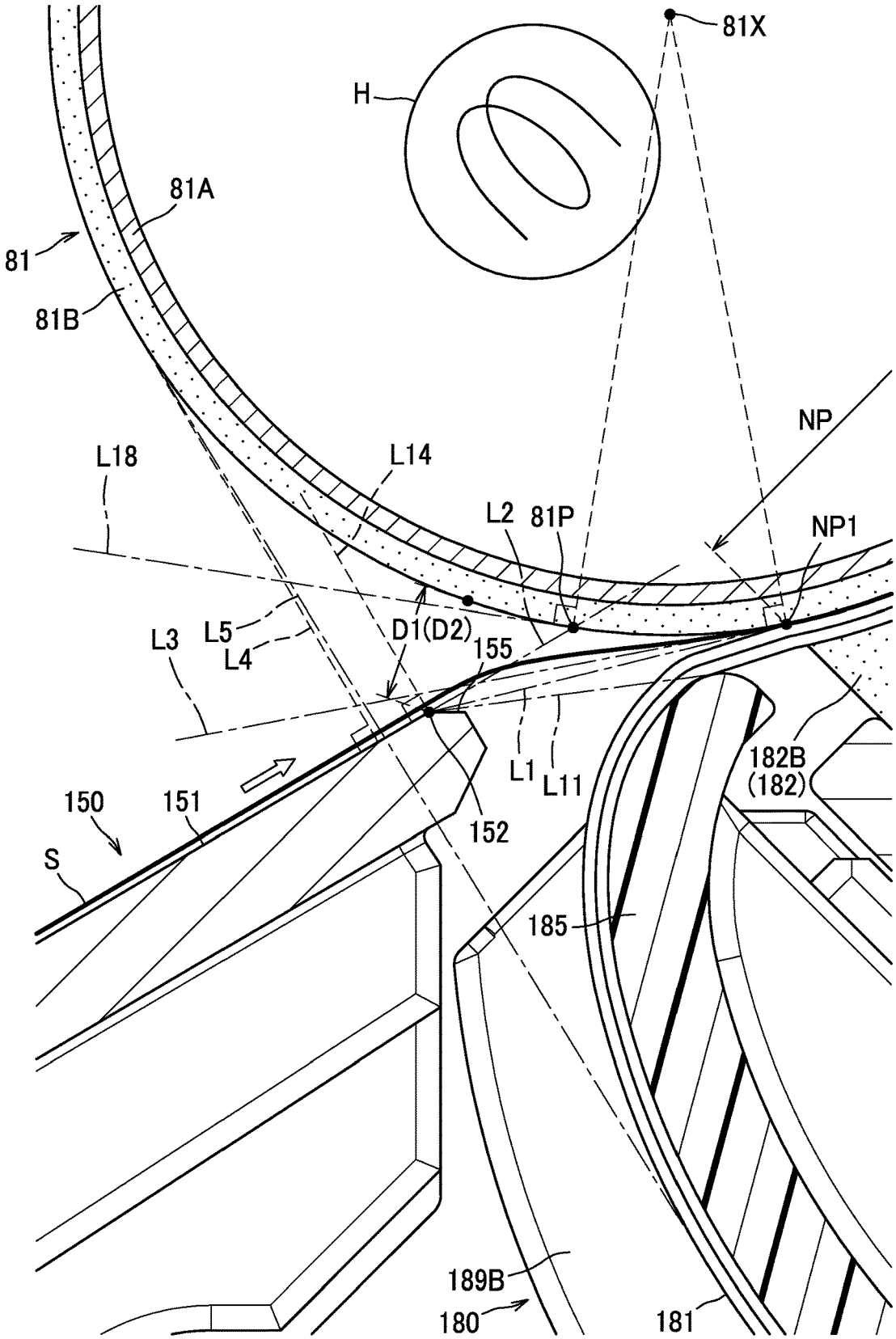
FIG. 5 is an enlarged sectional view showing an upstream end of the nip and its vicinity.

As shown in FIG. 5, in a section orthogonal to the rotation axis 81X of the roller 81, a line segment L1 connecting the downstream end 152 of the guide surface 151 and the upstream end NP1 of the nip NP does not intersect the upstream belt guide 185. In the illustrated example, since the belt 181 is positioned lower than the roller 81, the upstream belt guide 185 is positioned lower than the line segment L1.

Further, in comparison with a tangent line L11 which passes through the downstream end 152 of the guide surface 151 and contacts the end of the upstream belt guide 185 closest to the nip NP, the upstream end NP1 of the nip NP is positioned nearer to the center of the roller 81, i.e., the rotation axis 81X.

An extended line L2 extended from the downstream end 152 of the guide surface 151 along the guide surface 151 toward the roller 81 intersects a surface of the roller 81 at a position upstream of the upstream end NP1 of the nip NP in the conveyance direction. As shown in FIG. 2, the extended line L2 is a straight line connecting an intersection 154 of a straight line LS and the guide surface 151, and the downstream end 152 of the guide surface 151. The straight line LS is an extended line formed by extending the sheet conveying surface 73A of the conveyor belt 73 downstream in the conveyance direction. Since the extended line L2 intersects the surface of the roller 81, a sheet S guided by the guide surface 151 contacts the roller 81 at a position near the intersection 81P of the extended line L2 and the surface of the roller 81, as shown in FIG. 5. The angle formed between the tangent line L18 of the surface of the roller 81 passing through the intersection 81P and the extended line L2 is preferably 40 degrees or smaller.

In a section orthogonal to the rotation axis 81X of the roller 81, a tangent line L3 of the surface of the roller 81 at the upstream end NP1 of the nip NP does not intersect the guide surface 151. The angle formed between the tangent line L3 and the line segment L1 is preferably 10 degrees or smaller, more preferably 4 degrees or smaller.

Further, in a section orthogonal to the rotation axis 81A of the roller 81, the downstream end 152 of the guide surface 151 is located between the nip NP and a straight line L4 orthogonal to the guide surface 151 and tangent to the surface of the roller 81. In this case, a straight line L14 passing through the downstream end 152 of the guide surface 151 and extending orthogonal to the guide surface 151 intersects the roller 81. Furthermore, in a section orthogonal to the rotation axis 81X of the roller 81, the guide surface 151 intersects a common tangent line L5 tangent to the surface of the roller 81 and to the upstream belt guide 185 at positions upstream of the nip NP in the conveyance direction. In other words, the common tangent line L5 forms a boundary between a first region (the region on the right side of the common tangent line L5 in FIG. 5) in which the roller 81 is positioned and a second region (the region on the left side of the common tangent line L5 in FIG. 5) in which the roller 81 is not positioned, and the guide surface 151 is located in the second region. In such an arrangement, the downstream end 152 is located near the upstream end NP of the nip NP, and therefore, the chute 150 can guide a sheet S to the nip NP in a stable manner.

Figure 6:
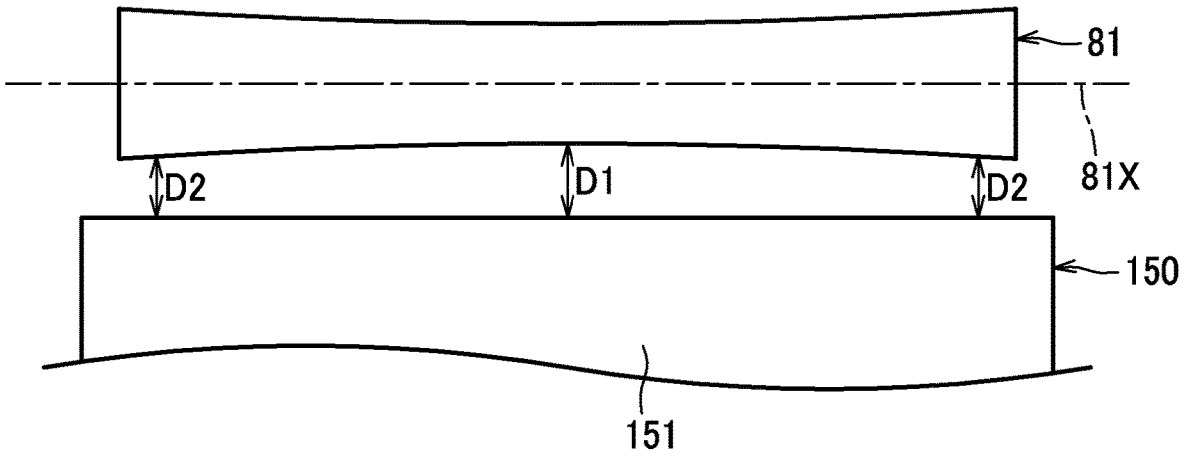
FIG. 6 is an illustration of the roller and the chute as viewed from above.

As shown in FIG. 6, the downstream end 152 of the guide surface 151 extends straight along the rotation axis 81X of the roller 81. The distance D1 from the downstream end 152 of the guide surface 151 to the roller 81 at a center portion of the roller 81 is longer than the distance D2 from the downstream end 152 of the guide surface 151 to the roller 81 at both ends of the roller 81. For example, if the roller 81 has a shape of an inverted crown in which the diameters of its ends are larger than a diameter of its center portion, when the downstream end 152 extends straight along the rotation axis 81X, the distance D1 from the downstream end 152 of the guide surface 151 to the roller 81 at the center portion of the roller 81 is longer than the distance D2 from the downstream end 152 of the guide surface 151 to the roller 81 at both ends of the roller 81.

It is to be understood that the above-described relationship between the chute 150 and the roller 81 or the belt unit 180 is at least satisfied when the roller 81 and the fixing device 8 are in a strong nip state.

In the illustrative, non-limiting embodiment described above of the image forming apparatus 1, the following advantageous effects can be achieved.

As shown in FIGS. 1 and 2, when a printing process is performed by the image forming apparatus 1, a toner image is formed on a sheet S while the sheet S is being conveyed by the conveyor belt 73. The sheet S with the toner image formed thereon is conveyed by the conveyor belt 73 on the conveying surface 73A of the conveyor belt 73, and after the leading edge of the sheet sticks out from sheet conveying surface 73A, the sheet S moves along the straight line LS. Subsequently, the sheet S with both sides guided by the belt frame 75 moves to a position above the guide surface 151 of the chute 150. The sheet S contacts the guide surface 151 near the intersection 154 of the straight line LS and the guide surface 151, and is then caused to curve upward by the guide surface 151 and moves along the guide surface 151.

As shown in FIG. 5, the leading edge of the sheet S passes the downstream end 152 of the guide surface 151, proceeds along the extended line L2, and contacts the surface of the roller 81 near the intersection 81P of the extended line L2 and the surface of the roller 81. The leading edge of the sheet S moves along the surface of the roller 81, passes the upstream end NP1 of the nip NP, and is drawn in by the roller 81 between the roller 81 and the belt 181. In the nip NP, the sheet S sandwiched between the roller 81 and the belt 181 is heated by the roller 81 whereby the toner image is fixed on the sheet S.

In this printing process, the sheet S guided to the nip NP by the guide surface 151 of the chute 150 contacts the surface of the roller 81 before contacting the belt 181. Therefore, the leading edge of the conveyed sheet S is guided steadily to the nip NP along the surface of the roller 81. Thus, it is possible to restrain the sheet S from being wrinkled.

The surface profile of the elastic layer 81B on the surface of the roller 81 is less likely to deform compared to that of the upstream elastic pad 182B of the nip forming member 182. Therefore, the sheet S can be stably guided to the nip NP along the surface of the roller 81.

In a section orthogonal to the rotation axis 81X of the roller 81, the tangent line L3 of the surface of the roller 81 at the upstream end NP1 of the nip NP does not intersect the guide surface 151. Therefore, when the leading edge of the sheet S contacts the roller 81, an angle formed between the surface of the roller 81 and the leading edge of the sheet S is small, and thus the leading edge of the sheet S smoothly moves along the surface of the roller 81 and the sheet S can be steadily guided to the nip NP.

In a section orthogonal to the rotation axis 81X of the roller 81, the downstream end 152 of the guide surface 151 is located between the nip NP and a straight line L4 orthogonal to the guide surface 151 and tangent to the surface of the roller 81. Therefore, the downstream end 152 of the guide surface 151 is close to the nip NP, so that the sheet S can be stably guided to the nip NP and restrained from being wrinkled.

In a section orthogonal to the rotation axis 81X of the roller 81, the guide surface 151 intersects a common tangent line L5 tangent to the surface of the roller 81 and to the surface of the upstream belt guide 185 at a position upstream of the nip NP in the conveyance direction. This also results in the downstream end 152 of the guide surface 151 being positioned close to the nip NP. Therefore, the sheet S can be stably guided to the nip NP and restrained from being wrinkled.

The distance D1 from the downstream end 152 of the guide surface 151 to the roller 81 is shorter at both axial ends of the roller 81 than at the center portion of the roller 81. Therefore, both ends of the leading edge of the sheet S contact the surface of the roller 81 before the center portion of the leading edge of the sheet S, and thus the sheet S is drawn into the nip NP from both ends of the leading edge thereof, and thus it is possible to further restrain the sheet S from being wrinkled.

Since the upstream end 153 of the guide surface 151 is positioned lower than the sheet conveying surface 73A of the conveyor belt 73 and upstream of the downstream end 75E of the belt frame 75 in the conveyance direction, the sheet S with both sides guided by the belt frame 75 is placed on the guide surface 151 of the chute 150 from above. Therefore, the sheet S can be steadily conveyed from the conveyor belt 73 to the chute 150.

The present invention is not limited to the above-described embodiment and may be implemented in various other forms as described below.

Although the roller 81 is heated by a heater H in the illustrated example, the belt 181 of the belt unit 180 may be heated by the heater H. Further, although the nip forming members 182, 183 of the belt unit 180 are comprised of stationary elastic bodies, they may be rollers. In an alternative configuration, a nip forming member may be comprised of a single elastic pad.

Although there are two heaters H in the illustrated example, there may be one heater or three or more heaters.

The elements described in the above embodiment and its modified examples may be implemented selectively and in combination.

What is claimed is:

1. A fixing device comprising:

a roller having a rotation axis;

a belt unit that conveys a sheet in a conveyance direction in combination with the roller, the belt unit comprising:

an endless belt;

a nip forming member that forms a nip in combination with the roller between the roller and the endless belt, the endless belt being sandwiched between the nip forming member and the roller, and the nip having an upstream end in the conveyance direction; and an upstream belt guide which guides an inner surface of the endless belt at a position upstream of the nip in the conveyance direction; and a chute having a guide surface configured to guide the sheet toward the nip, the guide surface guiding a surface of the sheet, and having an upstream end and a downstream end in the conveyance direction, wherein the downstream end of the guide surface is opposed to a peripheral surface of the roller, and wherein, in a section orthogonal to the rotation axis, a line segment connecting the downstream end of the guide surface and the upstream end of the nip does not intersect the upstream belt guide, an extended line extended from the downstream end of the guide surface along the guide surface toward the roller intersects a surface of the roller at a position upstream of the upstream end of the nip, and a tangent line of the roller surface at the upstream end of the nip does not intersect the guide surface.

2. The fixing device according to claim 1, wherein the roller comprises an elastic layer forming the surface thereof, wherein the nip forming member comprises an elastic pad that is elastically deformable, and wherein deformation caused when the roller and the nip forming member are pressed against each other is smaller in the elastic layer than in the elastic pad.

3. The fixing device according to claim 1, wherein, in a section orthogonal to the rotation axis, the downstream end of the guide surface is located between the nip and a straight line orthogonal to the guide surface and tangent to the surface of the roller.

4. The fixing device according to claim 1, wherein, in a section orthogonal to the rotation axis, the guide surface intersects a common tangent line tangent to the surface of the roller and to a surface of the upstream belt guide at a position upstream of the nip in the conveyance direction.

5. The fixing device according to claim 1, wherein an angle formed between the extended line and a tangent line of the surface of the roller which passes through an intersection of the extended line and the surface of the roller is 40 degrees or smaller.

6. The fixing device according to claim 1, wherein a sliding sheet having a coefficient of friction lower than a coefficient of friction of the upstream belt guide is placed between the upstream belt guide and the endless belt.

7. A fixing device comprising:

a roller having a rotation axis;

a belt unit that conveys a sheet in a conveyance direction in combination with the roller, the belt unit comprising:

an endless belt;

a nip forming member that forms a nip in combination with the roller between the roller and the endless belt, the endless belt being sandwiched between the nip forming member and the roller, and the nip having an upstream end in the conveyance direction; and an upstream belt guide which guides an inner surface of the endless belt at a position upstream of the nip in the conveyance direction; and a chute having a guide surface configured to guide the sheet toward the nip, the guide surface having an upstream end and a downstream end in the conveyance direction, wherein, in a section orthogonal to the rotation axis, a line segment connecting the downstream end of the guide surface and the upstream end of the nip does not intersect the upstream belt guide, and an extended line extended from the downstream end of the guide surface along the guide surface toward the roller intersects a surface of the roller at a position upstream of the upstream end of the nip, wherein the downstream end of the guide surface extends straight along the rotation axis, and wherein the distance from the downstream end of the guide surface to the roller is shorter at both axial ends of the roller than at the center of the roller.

8. An image forming apparatus comprising:

a fixing device comprising:

a roller having a rotation axis;

a belt unit that conveys a sheet in a conveyance direction in combination with the roller, the belt unit comprising:

an endless belt;

a nip forming member that forms a nip in combination with the roller between the roller and the endless belt, the endless belt being sandwiched between the nip forming member and the roller, and the nip having an upstream end in the conveyance direction; and an upstream belt guide which guides an inner surface of the endless belt at a position upstream of the nip in the conveyance direction; and a chute having a guide surface configured to guide the sheet toward the nip, the guide surface having an upstream end and a downstream end in the conveyance direction;

a conveyor belt configured to convey a sheet with a toner image formed thereon to the guide surface of the chute;

a belt roller around which the conveyor belt is looped; and a belt frame configured to support the belt roller, wherein, in a section orthogonal to the rotation axis, a line segment connecting the downstream end of the guide surface and the upstream end of the nip does not intersect the upstream belt guide, and an extended line extended from the downstream end of the guide surface along the guide surface toward the roller intersects a surface of the roller at a position upstream of the upstream end of the nip, and wherein the upstream end of the guide surface is located at a position lower than a position of a sheet conveyance surface of the conveyor belt and at a position upstream of a position of a downstream end of the belt frame in the conveyance direction.

9. The fixing device according to claim 8, wherein the roller comprises an elastic layer forming the surface thereof, wherein the nip forming member comprises an elastic pad that is elastically deformable, and wherein deformation caused when the roller and the nip forming member are pressed against each other is smaller in the elastic layer than in the elastic pad.

10. The fixing device according to claim 8, wherein, in a section orthogonal to the rotation axis, a tangent line of the roller surface at the upstream end of the nip does not intersect the guide surface.

11. The fixing device according to claim 8, wherein, in a section orthogonal to the rotation axis, the downstream end of the guide surface is located between the nip and a straight line orthogonal to the guide surface and tangent to the surface of the roller.

12. The fixing device according to claim 8, wherein, in a section orthogonal to the rotation axis, the guide surface intersects a common tangent line tangent to the surface of the roller and to a surface of the upstream belt guide at a position upstream of the nip in the conveyance direction.

13. The fixing device according to claim 8, wherein the downstream end of the guide surface extends straight along the rotation axis, wherein the distance from the downstream end of the guide surface to the roller is shorter at both axial ends of the roller than at the center of the roller.

14. The fixing device according to claim 8, wherein an angle formed between the extended line and a tangent line of the surface of the roller which passes through an intersection of the extended line and the surface of the roller is 40 degrees or smaller.

15. The fixing device according to claim 8, wherein a sliding sheet having a coefficient of friction lower than a coefficient of friction of the upstream belt guide is placed between the upstream belt guide and the endless belt.

* * * * *